US006481931B1

(12) United States Patent
Welsh

(10) Patent No.: US 6,481,931 B1
(45) Date of Patent: Nov. 19, 2002

(54) CANTILEVER SUPPORTED DRILLING RIG

(76) Inventor: Walter Thomas Welsh, 510 Farmington Dr., Lafayette, LA (US) 70582

( * ) Notice: Subject to any disclaimer, the term of this patent is extended or adjusted under 35 U.S.C. 154(b) by 0 days.

(21) Appl. No.: 09/665,023

(22) Filed: Sep. 19, 2000

(51) Int. Cl.[7] ..... E02B 17/00
(52) U.S. Cl. ..... 405/201; 405/195.1
(58) Field of Search ..... 405/201, 203, 405/204, 200, 199, 198, 197, 196, 195.1; 175/5, 7, 8, 9

(56) References Cited

U.S. PATENT DOCUMENTS 3,001,594 A * 9/1961 Suderow ..... 405/201
3,477,235 A * 11/1969 Branham et al. ..... 405/201
4,483,644 A * 11/1984 Johnson ..... 405/201
4,602,894 A * 7/1986 Lorenz et al. ..... 405/203
4,658,903 A * 4/1987 Tateishi ..... 166/335
5,052,860 A * 10/1991 Ingle ..... 405/201
5,248,003 A * 9/1993 Song et al. ..... 405/198
6,048,135 A * 4/2000 Williford et al. ..... 405/203
6,171,027 B1 * 1/2001 Blankestijin ..... 405/201

* cited by examiner

*Primary Examiner*—Heather Shackelford
*Assistant Examiner*—Frederick L. Lagman
(74) *Attorney, Agent, or Firm*—John D. Jeter

(57) ABSTRACT

The derrick is configured to place the lift axis of the crown block toward the aft end of the rig floor. Major floor loads such as draw works are moved closer to the platform. The spare line spool support is changed from rig floor to platform. The set back areas are distributed on both sides of the vee door.

4 Claims, 2 Drawing Sheets

CANTILEVER SUPPORTED DRILLING RIG

This invention pertains to structural arrangements to reduce the overhung load on cantilever rig supporting structure related primarily to platforms that float or stand on legs with limited load supporting ability.

BACKGROUND

Cantilever rig structures evolved from the need to drill more wells from offshore platforms and there is a need to provide means to change the load arrangement to reduce the effect of deadload extended from the side of platforms.

Some definitions are now in order. As used herein, the well centerline coincides with the hook lift axis. In changing the relationship between the well axis and structural features, the structure accepts the changes, assuming the well centerline is already defined. Things to be changed to accomplish the objects of the invention are defined, all else essential to the related drilling activity is encompassed by the terms platforms and drilling rigs. The installation alluded to is a jack-up rig with three legs as a matter of convenience. The invention is applicable to any installation that uses cantilevered beam arrangements, extending over the side, to support a drilling rig. Rig floor, as used herein, is synonymous derrick floor and drilling floor.

Offshore platforms are designed for particular vertical loads and those loads determine the required load supporting ability of the individual legs. The legs involved are usually columns driven into the sea bed or vertically movable legs of jack up rigs. When loads are supported on cantilever structure extended from one side of the platform the legs nearest the load center of gravity usually define the load supporting ability. The center of gravity of the composite load can be defined as being made up of indivisible load elements times their distance extended from the platform, as measured between gravity and vertical support vectors. In a practical sense the indivisible loads consists of such as draw works, hook loads, dynamic brakes, reels of spare line, racks of standing pipe, and the like.

When the need to accept more cantilever supported load than originally planned by design is realized, the structure under the load has to be strengthened. The structure added also adds to the load on the critical platform legs. When the support ability of the critical legs is approached, any dead load increase caused by added reinforcing of the extending platform reduces the total hook load carrying ability of the overall system.

Distinguishing between productive loads and static loads, racked pipe loads, hook load, draw works weight, and the like can be considered productive loads. The structure added to support those loads can be considered static loads. Both these defined type loads are extended over the side of the platform. These loads tend to lift the distant legs and add that lift load to the downwardly directed load on the nearest, most critical, legs.

The effect of extended loads is proportional to the distance of the specific load from the edge of the platform. Placing the productive load nearer the platform reduces the needed static structure, and its static weight, as well. The benefit is cumulative.

Some dimensions are fixed, such as the distance of the hook load vector relative to the platform. That distance is fixed by the well bore position relative to the platform. When the conventional rig was modified to extend from the conventional platform, the derrick structure was not modified to achieve the fixed load requirements while minimizing the overhung load effects. There are no fundamental requirements that dictate a symmetrical derrick structure that evolved with the drilling industry. The well bore is conventionally in the geometric center of the derrick floor plan, and that is not necessary.

The arrangement of draw works, tubular goods racking structure, and the vee door through which new tubular lengths are drawn into alignment with the well bore have to be in view of the driller. That requirement defined rig floor layouts that evolved under symmetrical derricks. When the derrick was extended over the side of the platform, the original layout was accepted, and design factors took the current loads into consideration. Those current loads were factored into the design of the platforms and cantilever structure. The system was, at that time, satisfactory. Deeper drilling, increased drill string diameter, and multiple completions added loads not originally expected. With added loads, overload problems arose. The present invention addresses changes from conventional derrick shape and rig floor layouts to reduce the effect of overhung loads.

SUMMARY OF INVENTION

The rig floor plan is changed to place the vertical hook lift axis about one third of the floor length from the aft end of the floor. Compared with the usual thirty foot square rig floor with a centered hook lift axis, that change moves the permissible well center line five feet farther aft. With a given distance between a well centerline and the aft end of the platform hull, the rig floor can be moved five feet toward the hull. The result is a greatly reduced bending moment on the cantilever beams supporting the rig. The draw works, and it's related dynamic brake, are moved from the aft end of the rig floor to the port side of the floor, somewhat more toward the hull. The drillers position and related protective structure is between the draw works and the aft end of the rig floor, positioned to allow the driller a view of the traveling block path, vee door, and set back area. The set back area, increased by aftward movement of the hook lift axis, is divided and placed on opposite sides of the vee door which is generally centered, and unchanged, on the fore side of the derrick.

The derrick is asymmetrical in the central longitudinal vertical plane, with the crown block arranged to place the hook lift axis as stated. The port and starboard sides of the derrick are arranged to generally support the vertical stands of pipe in the set back areas.

The spare line spool support is moved from the rig floor to the hull.

The object of this invention is to reduce the bending moment on the cantilever beams supporting a drilling rig.

It is another object to move the hook lift axis, relative to the rig floor, to allow the rig floor to be moved toward the supporting platform to reduce bending moment on the cantilever beams.

It is yet another object to rearrange heavy machinery on the rig floor to place the heavier portions toward the platform to reduce bending moment on the cantilever beams.

It is still another object of the invention to increase the reach of the drilling system to place the platform farther from the most distant well centerline.

These and other objects, advantages, and features of this invention will be apparent to those skilled in the art from a. consideration of this specification, including the attached claims and appended drawings.

BRIEF DESCRIPTION OF DRAWINGS

In the drawings wherein like features have similar captions.

FIG. 1 is a top view of a platform and attached, cantilever supported drilling rig without the derrick normally above the drilling floor.

FIG. 2 is a side view of the structural assembly of FIG. 1.

DETAILED DESCRIPTION OF DRAWINGS

Figure 1:
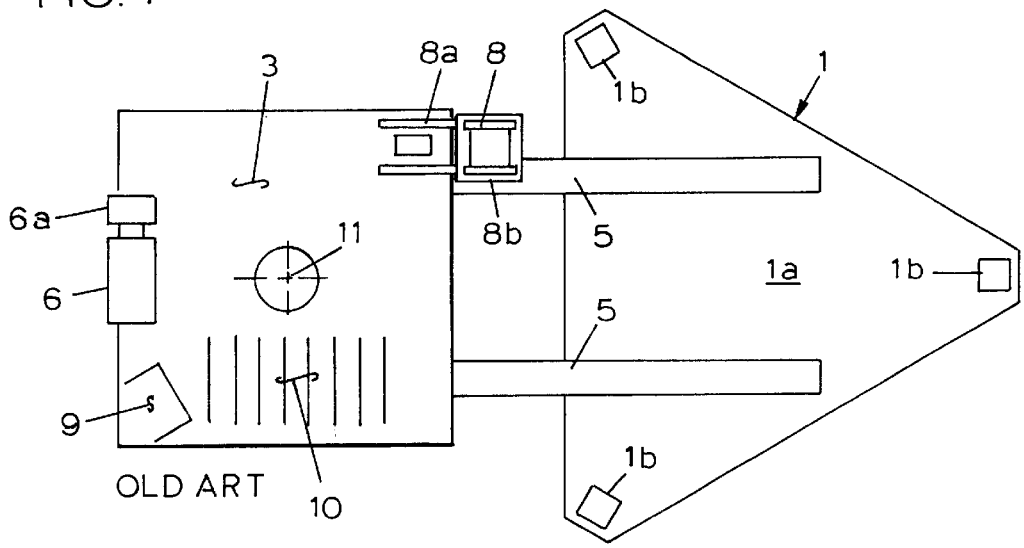
FIGS. 1 and 2 are old art.

In the drawings, some details of construction that are well established in the art, and having no bearing upon points of novelty, are omitted in the interest of clarity of descriptive matter. Such details may include some structural beam shapes, ladders, pipe tongs, hoisting gear, drive motors, and pumps.

In FIGS. 1 through 4 the scale of the platform is small compared with the derrick and drilling floor to permit inclusion of details needed for clarity of relationships.

Figure 2:
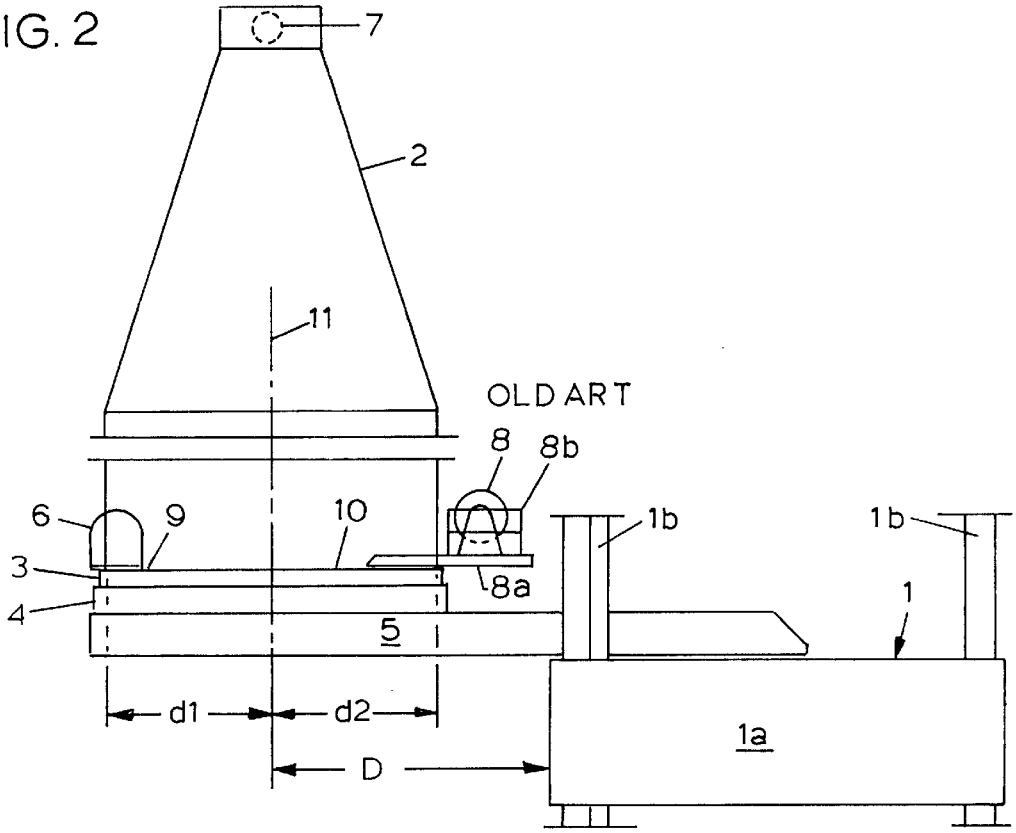

In FIGS. 1 and 2 the platform 1 shows hull 1*a* and legs 1*b*. This is an extreme simplification because the hull is commonly crowded with machinery and various structures such as cranes, living quarters, and helicopter pad. Only the hull and supporting legs are significantly involved in influencing the need for the present invention. There are many forms of platforms, the jack-up rig shown is typical of the many different drilling arrangements needing the present invention.

Cantilever beams 5 extend over the side of the hull and support transverse structure 4 which supports rig floor 3. Derrick 2 is supported above the rig, or drilling, floor. The derrick is on the aft end of the hull. The drilling rig can be skidded both longitudinally and transversely to position the vertical hook load gravity line, hence the well centerline 11, relative to the hull. Along the longitudinal direction, the drilling rig can usually be skidded onboard the hull for movement to other locations. The derrick is actually smaller than shown relative to the hull.

Figure 3:
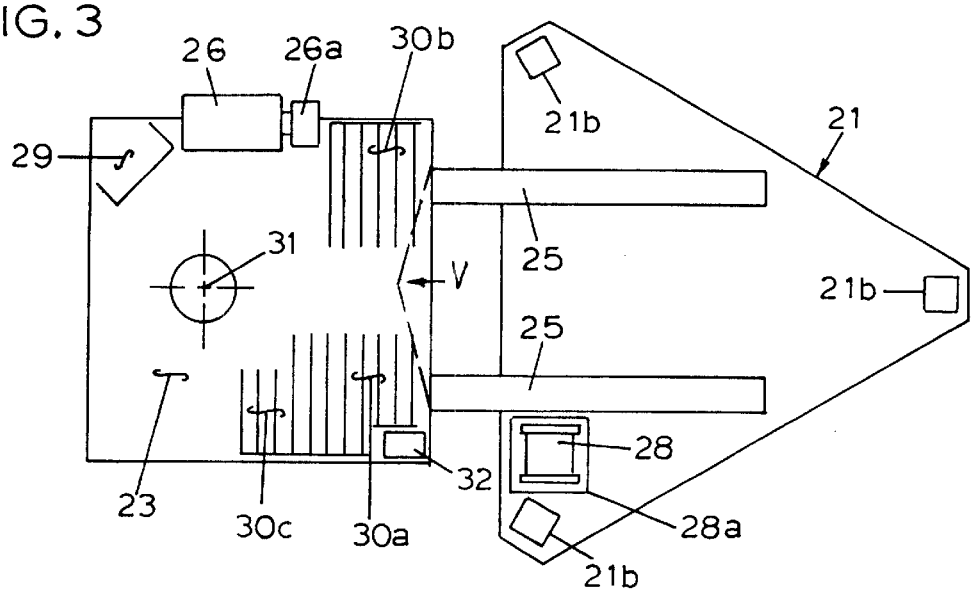
FIG. 3 is a top view (novel version) of a platform and attached, cantilever supported drilling rig without the derrick normally above the drilling floor.
Figure 4:
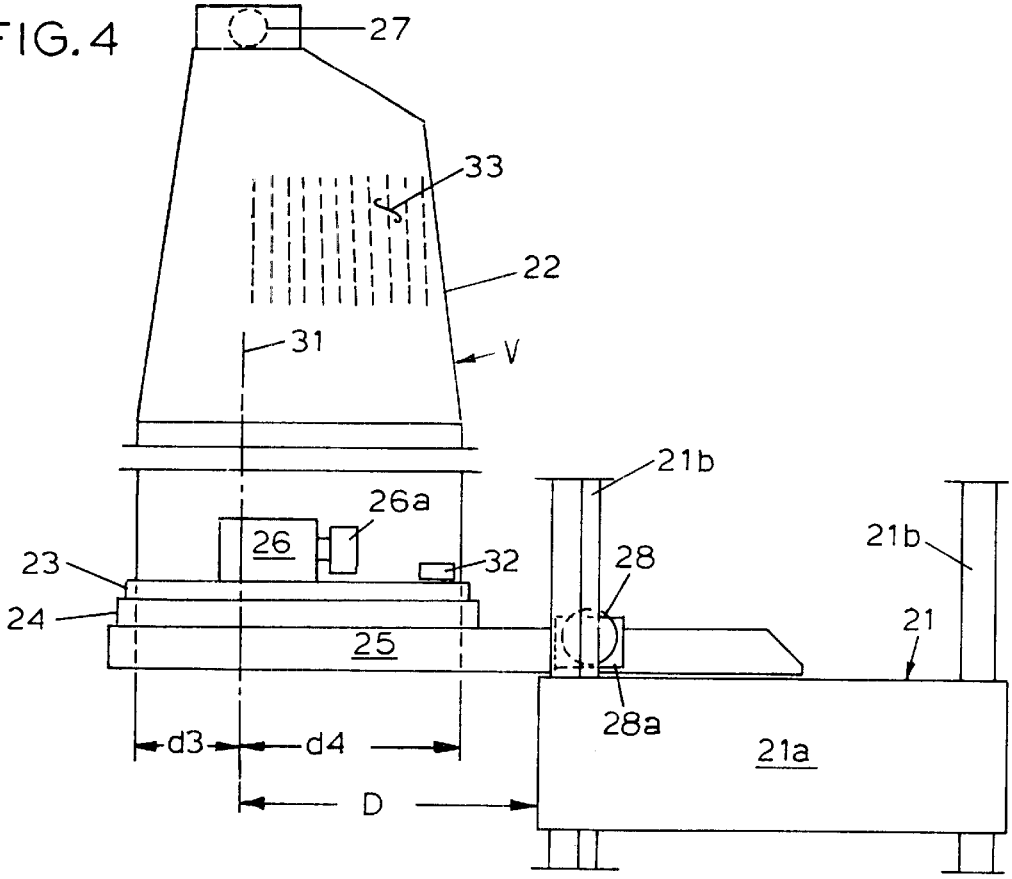
FIG. 4 is a side view of the structural assembly of FIG. 3.

The draw works 6 is located on, and usually protrudes over the aft end of the rig floor. The drillers location is usually a small protected area 9 that stands on the drilling floor. The set back 10 is an area on the drilling floor which receives the lower end of temporarily stored pipe lengths from a drill string usually being removed from or being installed back into the well. The spare line reel 8 usually stands cantilever supported off the drilling floor by structure such as beams 8*a*, within rail enclosure 8*b*. The crown block 7 is usually centered over the well centerline. It is in the general center of generally symmetrical plan view of the derrick. The usual drilling floor is crowded with apparatus, such as power tongs and pipe spinning apparatus, not germane to this disclosure and, hence, not shown in the interest of clarity and simplicity. In FIGS. 3 and 4 the platform 21 includes hull 21*a* and jack-up legs 21*b*. Cantilever support beams 25 extend outboard to support the drilling rig. The floor plan, distribution of heavy machinery, and the derrick differ from the old art. No change is required of the platform, other than accepting the spare line reel 28 and it's protective railings 28*a*.

All operationally required equipment not defined as part of the novel arrangement can be considered part of the drilling rig by definition.

The derrick 22 is asymmetrical in the longitudinal plane. The crown block 27 is situated to position the center of crown block, which defines the well centerline, about one-third the floor length dimension from the aft end of the drilling floor. The dimension d3 is about one half the dimension d4. The dimension D is the distance of a given well centerline 31 from the aft edge of the hull. That dimension is usually a given for many reasons. The asymmetrical derrick allows the geometric center of the drilling floor, and it associated load to be moved closer to the hull. That alone reduces the bending moment on the beams 25, if all else were considered constant.

To further reduce overhung load on beams 25, the draw works 26 and its associated dynamic brake 26*a* are moved from the aft end of the drilling floor to the port side, and somewhat forward of the aft floor boundary. The driller's position 29 is usually close to the draw works and remains so in the novel arrangement. Yet more overhung weight is reduced by moving the spare line reel 28, which usually weighs several tons, to the hull. It is positioned on the hull, within protective cage 28*a*. The dead line clamp 32 is not part of the invention but it is shown near the spare line reel, on the rig floor.

Transverse structure 24 distributes the rig related weight on beams 25. In most cases, the rig can be skidded a limited amount transversely to position the derrick over a well centerline.

Drilling floor 23 has set back sub-areas 30*a* and 30*b* and 30*c* for storing drill string sections 33 on end while the string is being tripped.

The weight on the drilling floor can be further reduced by provision of a light weight draw works, a Varco AC drive three to five thousand horsepower unit.

From the foregoing, it will be seen that this invention is one well adapted to attain all of the ends and objects hereinabove set forth, together with other advantages which are obvious and which are inherent to the invention.

It will be understood that certain features and sub-combinations are of utility and may be employed without reference to other features and sub-combinations. This is contemplated by and is within the scope of the claims.

As many possible embodiments may be made of the features of this invention without departing from the scope thereof, it is to be understood that all matter herein set forth or shown in the accompanying drawings is to be interpreted as illustrative and not in a limiting sense.

I claim:

1. A combination derrick adaptation and a drilling floor plan for a cantilever supported drilling rig having a fore end adjacent a supporting hull, and an aft end, a port side and a starboard side, with a vee door at the fore end, arranged for a main hoist hook load axis extending through said floor, the combination comprising:

a) set back areas for racked pipe on each transverse side of the vee door, on the fore end of said floor;

b) draw works on the port side of said floor;

c) dynamic brake at the fore end of the draw works;

d) drillers station aft of the draw works, on the port side;

e) spare line spool on the hull; and f) said derrick extending upward from the floor and arranged to suspend a drill string along the well centerline about one third of the floor length from the aft end.

2. The combination of claim 1 wherein said draw works is a Varco AC drive three thousand to five thousand horsepower unit.

3. The combination of claim 1 wherein the aft end of said draw works is at least eight feet forward of the aft end of the rig floor.

4. The combination of claim 1 wherein said set back areas are divided into three separate sub-areas, a first sub-area on the port side of the vee door, a second sub-area on the starboard side of the vee door, and a third sub-area having less transverse dimension than said second sub-area situated aft of said second sub-area.

* * * * *